US011465023B1

(12) United States Patent
Acuna, Jr.

(10) Patent No.: US 11,465,023 B1
(45) Date of Patent: Oct. 11, 2022

(54) BASEBALL FIELDING MAT APPARATUS AND METHOD

(71) Applicant: Roberto Acuna, Jr., Katy, TX (US)

(72) Inventor: Roberto Acuna, Jr., Katy, TX (US)

( * ) Notice: Subject to any disclaimer, the term of this patent is extended or adjusted under 35 U.S.C. 154(b) by 0 days.

(21) Appl. No.: 16/826,277

(22) Filed: Mar. 22, 2020

(51) Int. Cl.
*A63B 69/00* (2006.01)
*A45F 3/14* (2006.01)

(52) U.S. Cl.
CPC ..... *A63B 69/0002* (2013.01); *A45F 3/14* (2013.01); *A63B 2069/0011* (2013.01)

(58) Field of Classification Search
CPC ..... A63B 69/0002; A63B 2069/0011; A63B 26/00; A45F 3/14
USPC ..... 473/422, 451; 482/142, 23
See application file for complete search history.

(56) References Cited

U.S. PATENT DOCUMENTS 2,465,725 A * 3/1949 Herzmark ..... A61H 7/00 482/79
3,968,967 A * 7/1976 Nally ..... A63B 69/0097 473/423
4,329,981 A * 5/1982 Dungl ..... A61H 7/001 601/28
5,622,369 A * 4/1997 Rogers ..... A63B 63/007 273/398
5,865,664 A * 2/1999 Martey ..... A63H 5/00 446/397
6,010,414 A * 1/2000 Snow ..... A63B 69/0097 473/422
7,207,565 B1 * 4/2007 Masty, III ..... A63B 63/007 273/342
10,045,647 B2 * 8/2018 Publicover ..... A63B 21/023 428/220
10,398,968 B2 * 9/2019 Zeng ..... A63H 33/006
D894,308 S * 8/2020 Bakshi ..... D21/811
2009/0260157 A1 * 10/2009 Gere ..... A45C 9/00 5/417
2011/0072581 A1 * 3/2011 Villa ..... A63B 21/4037 5/420
2012/0317719 A1 * 12/2012 Ng ..... A63B 21/4037 5/417
2013/0324382 A1 * 12/2013 Wilson ..... A61H 7/007 482/142

* cited by examiner

*Primary Examiner* — Mitra Aryanpour
(74) *Attorney, Agent, or Firm* — Rick B. Yeager

(57) ABSTRACT

A training device and method for baseball, softball, and other sports provides a plurality of fixed or adjustable bump elements on a transportable support surface so the device can be easily stored, transported, and positioned for hop drills and other training routines. In one embodiment, the device is a flexible one-piece mat or other support surface with a plurality of integral bump elements. The mat may be rolled for storage, transported with a carry arm strap, unrolled into a desired position on a field or indoor practice area, and then used to deflect balls that are rolled over it. After use, the device rolls up easily for transport and storage.

14 Claims, 4 Drawing Sheets

BASEBALL FIELDING MAT APPARATUS AND METHOD

BACKGROUND

Field of the Invention

The current invention relates to sports training device, and more particularly to a baseball or softball fielder's training device.

Prior Art

Baseball and softball athletes often train with a "bad hop" drill to improve hand/eye coordination, reaction time, agility, and sports specific cardio. This drill teaches players how to field a baseball or softball coming off a "bad hop" by placing PVC pipe, small logs, cones, agility cones or other obstacles in the path of a ball so that the ball deflects, and the player can react to the deflection or "hop". Coaches typically lay these obstacles in a pattern, and roll balls over these to where the ball bounces off at different heights and speeds. This is a great drill for athletes, but can be a problem for coaches and trainers, because it requires the transport and set-up of the obstacles to prepare for the drill, and storage space after a drill.

SUMMARY

Various embodiments for baseball, softball, and other sports provide a plurality of fixed or adjustable bump elements on a transportable support surface so the device can be easily stored, transported, and positioned for hop drills and other training routines.

In one embodiment, the Fielder's Mat™ is a flexible one-piece mat or other support surface with a plurality of integral bump elements. The mat may be rolled for storage, transported with a carry arm strap, unrolled into a desired position on a field or indoor practice area, and then used to deflect balls that are rolled over it. After use, the device rolls up easily for transport and storage. The device eliminates the need to carry and set-up multiple training obstacle elements, and substantially improves the convenience of executing training drills. In addition, the relatively small three-dimensional "bump elements" provide a surprising lateral and height range of bounce, thereby requiring the athlete to move laterally quickly in response to the bounce. By contrast, prior art PVC pipe drills may produce different bounce heights, but may have limited lateral bounce.

The fielder's mat may be used for baseball players of all ages. It is designed to teach hand/eye coordination, reaction time, agility, sport specific cardio, and teaches the ability to field baseballs that come up off the ground at different heights, angles, and speeds.

In other embodiments the The fielder's mat has different size or feature alignment for use with other sports such as soccer or hockey.

DETAILED DESCRIPTION

Figure 1:
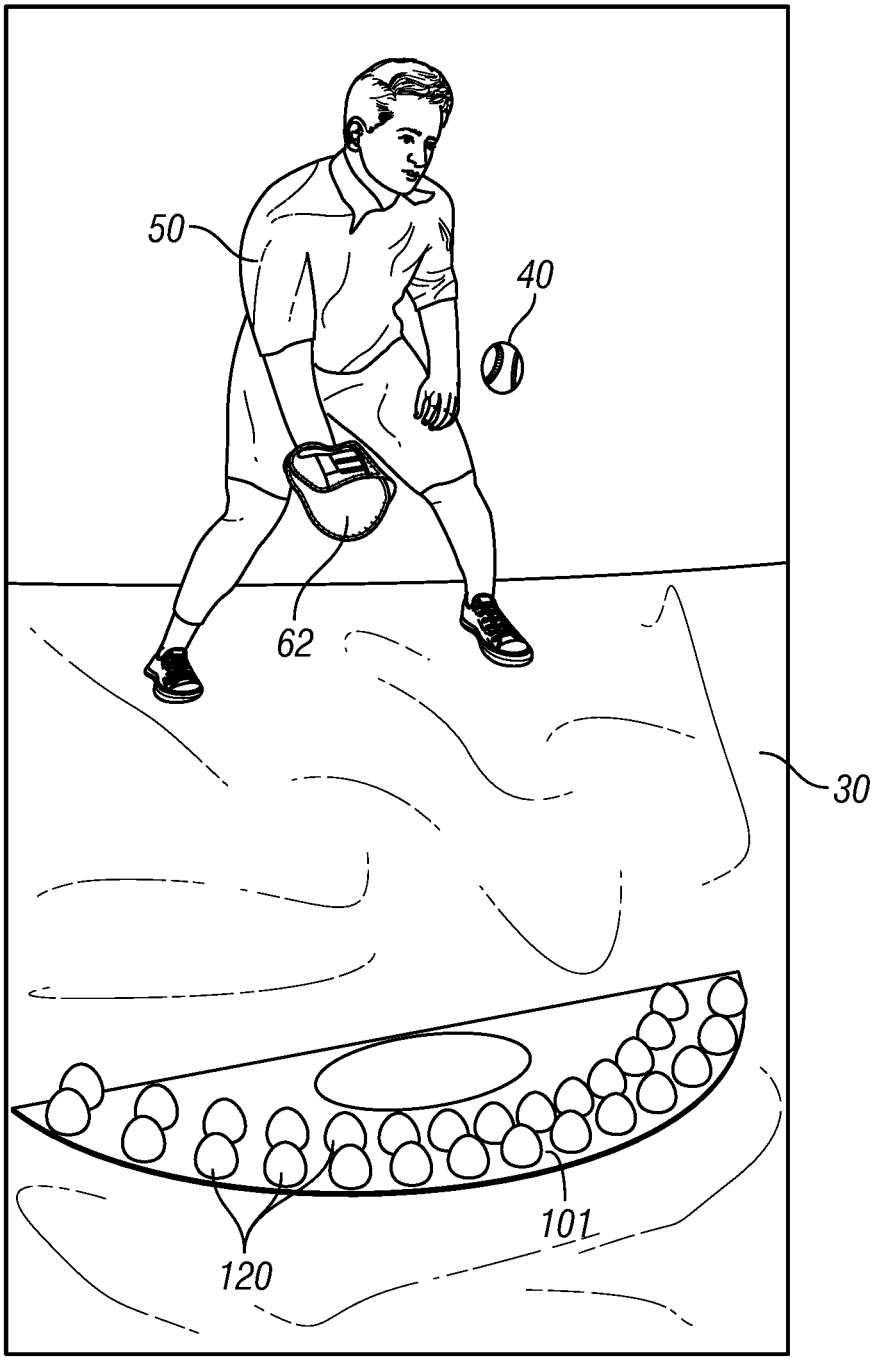
FIG. 1 is a front perspective view of a baseball player in a first fielding position behind an example baseball fielding training mat.

The following element list is provided for convenience in reviewing the figures:

ground or floor 30
baseball 40
user 50
  head 51
  shoulders 52, 53
  arms 58, 59
  hands 60, 61
  glove 62
  feet 64, 65
training device 101
base or support surface 110
  bounce features or bump elements 120A, 120B, 120C
  front edge 132
  rear edge 134

Definitions

In this specification, the terms "bump element" or "bounce features" refer to one of a plurality of raised features provided on a support surface to facilitate sports training. In one example for baseball fielder training drills, the features have a hemispherical or other shape configured to create a hop or bounce when a baseball is rolled over the feature. For fielder training, a plurality of bump elements are positioned in regular or irregular spacings on the support surface so that most or all rolls of a baseball over the support surface produce a hop or bounce from at least one of the bump elements.

In this specification, the term "support surface" refers to a planar substrate which has integral or supports detachable bump elements. In various embodiments, the support surface may be rigid or flexible. Some examples of flexible support surfaces include polymer or rubber mats, and mesh.

In this specification, the term "hemispherical" refers to hollow or solid upwardly-oriented bump elements that have an approximate shape of half or less than half of a sphere. The term "spherical segment" means a bump element whose shape is defined by cutting a sphere with a pair of parallel planes where one plane is located at or below the cap of the sphere and the other plane is located at or above the equator of the sphere. Thus, the top of the spherical segment may be rounded or truncated.

The term "asymmetric spherical segments" refers to a shape approximately the shape of a portion of a sphere cut by a plane that is oriented at an angle with respect to the sphere's equator so that the bump element tilts with a longitudinal axis that is not perpendicular to the support surface. In this specification, the term "asymmetric cap" means a hollow or solid upwardly-oriented element whose shape is defined by cutting a sphere with a plane that is not parallel to the equator of the sphere, this is located at or below the cap of the sphere and the other plane is located at or above the equator of the sphere, thus creating a bump element that has a longitudinal axis that is tilted with respect to the device base.

In this specification, the terms "rounded" or "smoothed" refer to bump element surface that have gradual transitions of tangent vectors. By contrast, the term "angular" refers to bump element surfaces with stepped or otherwise irregular features.

In this specification, the term "irregular in shape" refers to different sizes of the same shape, different orientations of an asymmetric shape, or different shapes of bump elements. In this specification, the term "irregularly shaped bump element" refers to a 3-dimensional shape other than a spherical or conical section.

In this specification, the term "irregularly spaced" refers to variable minimum spacings between bump elements.

In this specification the term "unpredictable hop or bounce" means that a sports player in a training session cannot easily predict the location of a hop or bounce as a ball approaches the device because slight variations in the path or speed of a ball as it impacts one or more bump element will result in a wide range possible angular and height deflections of the ball.

FIG. 1 is a front perspective view of a baseball player 50 in a first crouched fielding positioned behind an example baseball fielding training mat 101 placed on ground or a floor 30. In this figure, a baseball 40 has been rolled over the training mat and has hit one of a plurality of bounce features 120. In this case, the baseball 40 has bounced relatively high and to the left side of the player 50 and the player is moving his glove 62 to intercept the ball.

Figure 2:
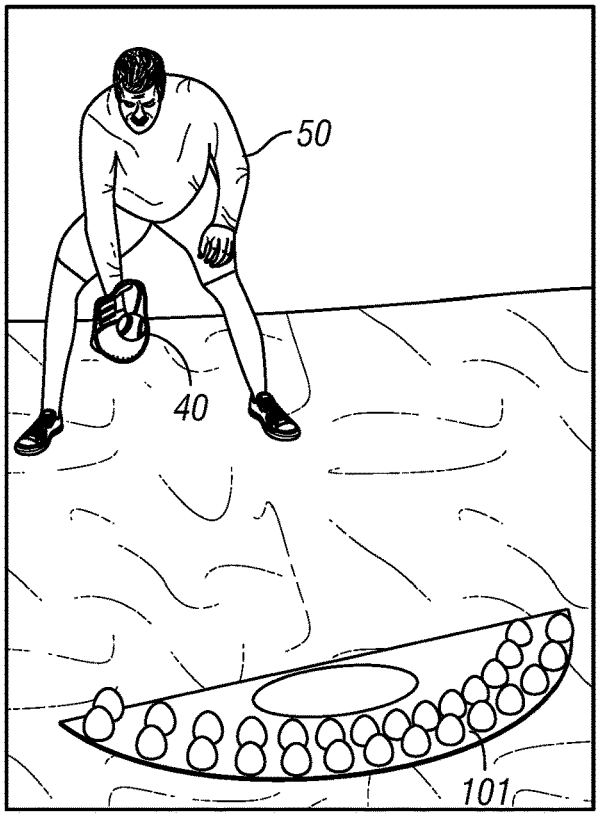
FIG. 2 is a front perspective view of a baseball player in a second fielding position behind the example baseball fielding training mat of FIG. 1

FIG. 2 is a front perspective view of the baseball player 50 in a second crouched fielding position behind the example baseball fielding training mat 101 of FIG. 1.

Figure 3:
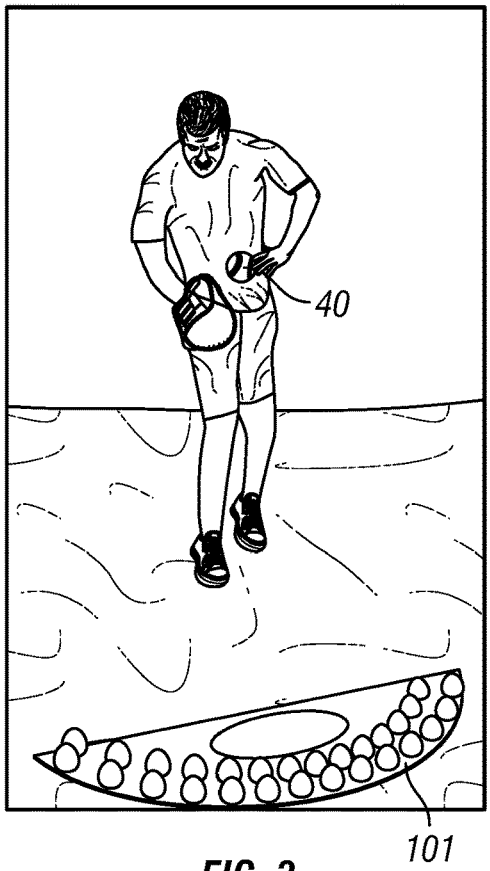
FIG. 3 is a front perspective view of a baseball player in a third fielding position behind the example baseball fielding training mat of FIG. 1.

FIG. 3 is a front perspective view of the baseball player 50 in a third fielding position behind the example baseball fielding training mat 101 of FIG. 1. In this example, the baseball 40 is taking a high bounce from the baseball fielding training mat 101 and the player has risen from the crouched position. In general, the unpredictable and wide range of ball bounce heights and angular deflection are useful in training both responses and providing sports-specific cardio training.

Figure 4:
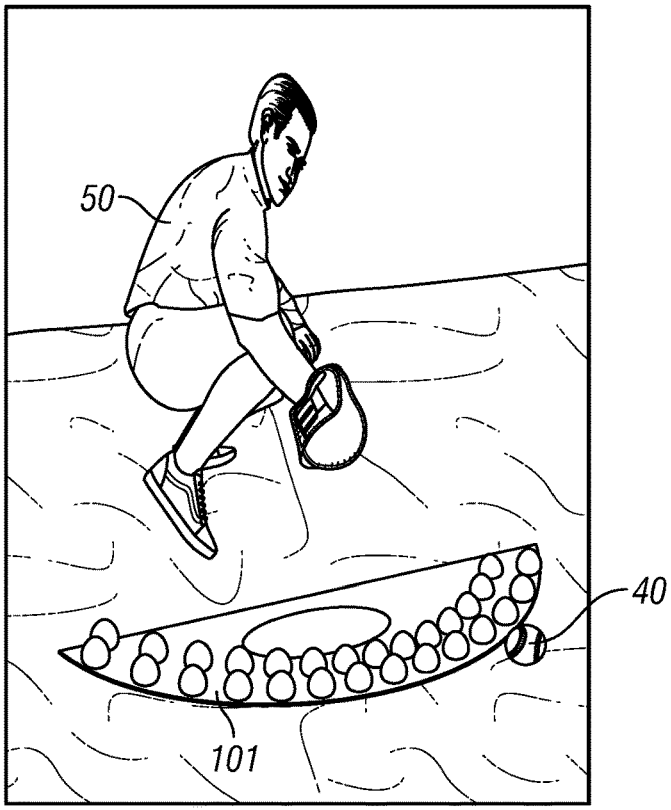
FIG. 4 is a front perspective view of a baseball player in a fourth fielding position behind the example baseball fielding training mat of FIG. 1.

FIG. 4 is a front perspective view of a baseball player 50 in a fourth fielding position behind the example baseball fielding training mat 101 of FIG. 1. In this example, the player is anticipating a bounce to the left of the player and is in a ready position to field the ball 40 in a backhand manner, but can move his glove to field the ball in the event the ball bounces to his right. The player can reach the ground with his glove in the event of a low hop, or can rise if necessary to catch a higher bounce. The player must react quickly at the time the ball 40 hits the may the baseball fielding training mat 101. Prior art training methods typically do not provide practice on this type of last-instant reaction.

Figure 5:
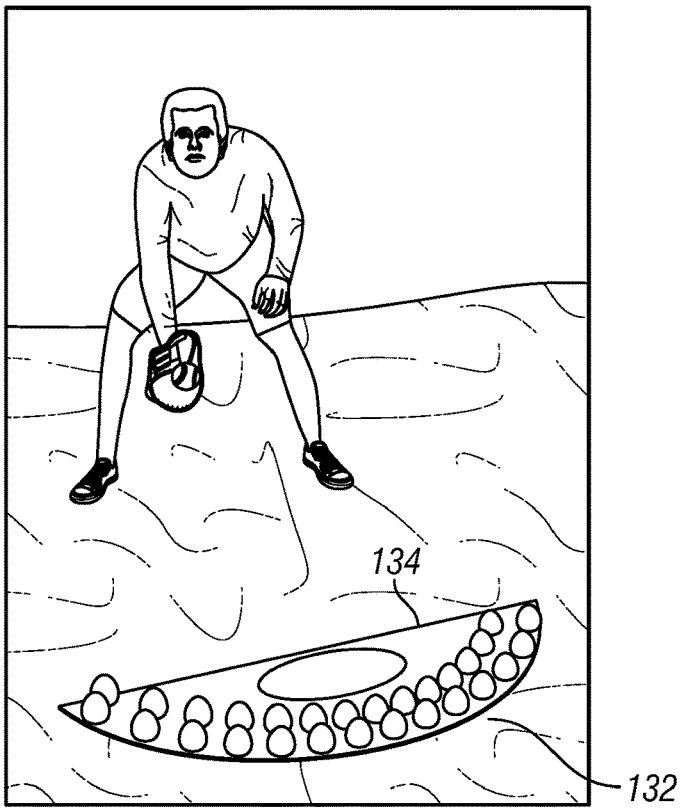
FIG. 5 is a front perspective view of a baseball player in a fifth fielding position behind the example baseball fielding training mat of FIG. 1.

FIG. 5 is a front perspective view of a baseball player 50 in a fourth fielding position behind the example baseball fielding training mat 101 of FIG. 1. In this example, the ball has bounced after impacting one or more bump element provided between the front edge 132 and the rear edge 134 of the mat. In this example, the rear edge is straight and the front edge is rounded. The placement of bump elements relative to the rounded front edge creates additional depth of bounce variation.

Figure 6:
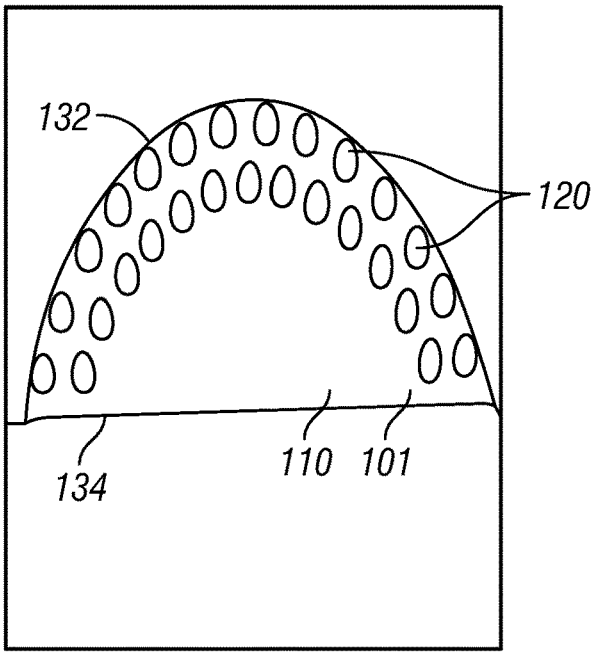
FIG. 6 is a top view of the example baseball fielding training mat of FIG. 1.

FIG. 6 is a top view of the example baseball fielding training mat 101 of FIG. 1 with a plurality of bump elements 120 positioned on support surface 110.

Figure 7:
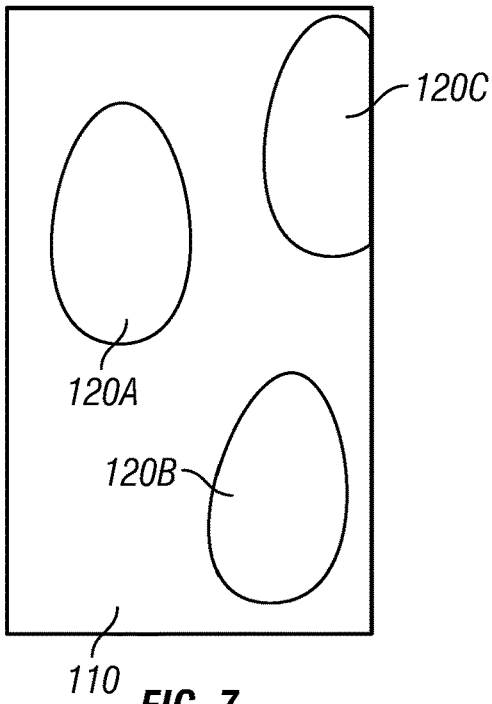
FIG. 7 is a detailed top view of the example baseball fielding training mat of FIG. 1 showing individual bump elements.

FIG. 7 is a detailed top view of the example baseball fielding training mat of FIGS. 1 and 6 showing spaced apart bump elements 120A, 120B, and 120C positioned on support surface 110. In this example the bump elements are hollow, regularly spaced hemispherical features integral to the support surface, and may be formed by a molding process. In other examples, the bump elements may be rigid. In other examples, the bump elements may have different shapes or sizes. In other examples, the bump elements may have irregular spacings.

Figure 8:
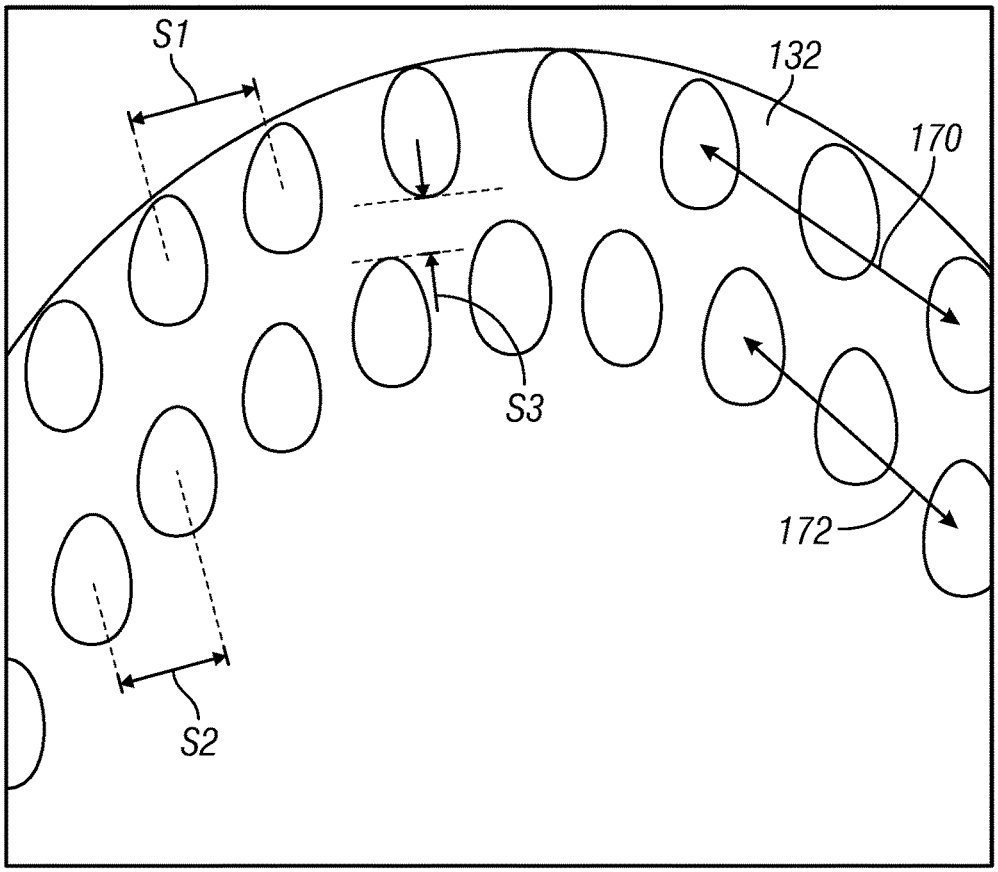
FIG. 8 is a detailed top view of the example baseball fielding training mat of FIG. 1 showing example layout and spacing of bump elements.

FIG. 8 is a detailed top view of the example baseball fielding training mat of FIGS. 1 and 6 showing a first row 170 of bump elements aligned parallel to front edge 132, and a second row 172 of bump elements, In this example, the second row 172 is parallel to the first row 170, and spaced apart from the first row by a distance S3. The bump elements in the front row have a spacing S1, and the bump elements in the front row have a spacing S2. In other examples, the bump elements may have irregular spacings.

EXAMPLE

FIGS. 6-8 show an example device with regular spaced bump elements. In this example, 14 hemispherical bump elements are arranged in a first row 170 with a 2.5 inch spacing between elements. A second row 172 concentric to the first row has 13 hemispherical bump elements with a 2.5 inch spacing between elements. There is a 2 inch spacing between the first row.

In this example, the bump elements are hemispherical in shape with a 1.5" radius and center height. In other examples, the bump elements may range from about 1" to 5" in diameter and 1" to 3" in center height. The device rolls out smoothly on a flat surface and can vary in dimension with ranging from 4 feet long and 2 feet wide, to 8 feet long and 2 feet wide.

Example—Embedded Bump Elements

In this example, the device has a plurality of embedded bump elements which can can vary in diameter and height size, and can be embedded in a systematic layout, or sporadically; depending on the sport for which it is designed. The mat portion may be soft material, while the embedded bump elements are of a hard material to be able to withstand ball impact. The corners of the mat are made of heavier material in order to keep the mat flat on the ground and to prevent the corners of the mat from coming off the ground. In other examples, the mat has rings on each corner that can allow for a stake to be pushed through into the natural ground.

Example—Self Training Hopper Devices

In the examples described above, a coach or assistant typically rolls a baseball over the device. In other examples, the device may be used with an automatic gravity fed or mechanical roller device which is configured to roll a plurality of balls in sequence over a bump element device.

In one example a hopper is positioned at sufficient height that when it releases a ball down a launch tube, the ball will obtain a desired rolling speed. The term rolling refers to either a path where a ball remains in contact with the ground or floor, or a path where the ball may lose contact with the ground or floor for one or more portions of the distance between the hopper and the the bump elements. In other examples, one or two balls may be used so that a first ball is fielded by the player and thrown back against a reception net positioned over the hopper as a second ball is released from the hopper. Various delay durations can be provided by altering internal paths within the hopper.

Example—One-piece Solid

In one embodiment the Fielder's Mat™ comprises a single molded material such as a urethane or other polymer, a neoprene or other rubber, a silicone, or other flexible material. The molding process may be injection molding, pour molding, blow molding, or other production process. The device rolls up similar to a yoga mat for easy storage, and also has a carry arm strap or sling. In a baseball example, the support surface has an overall length of 4 to 8 feet, and a maximum width of 2 to 4 feet. The support surface may be provided in a variety of shapes including tapered, arced, or rectangular. The edges or corners of the mat may be thicker or may include weights to prevent lifting of the mat. The edges or corners may also have rings or holes to permit staking the mat to the ground.

In this example, the device has integral bump elements on the front end of the mat which can be the same or variable shape, width or diameter, and height. The bump elements may be arranged in regular or irregular spacing In use, the device is rolled out on a flat surface and a coach or automatic feed device rolls balls toward and over the device.

Example—Stackable Sections

In this embodiment, the support surface is provided in two or more sections. Edges of the sections are designed to be abutted, overlapped, or interlocked. The sections have hollow bump elements on the same spacings so that the bump elements of one section may be partially nested within the hollow bump elements of another section. After transport, the sections are assembled into a larger support surface.

Example—Embedded Bump Elements

In this embodiment, a mat support surface is provided in a material that is flexible enough to be easily rolled, and separate bump elements of a more rigid material are embedded into or adhered to the mat. In this example, the mat typically has a thickness of ⅛ inch to ⅜ inch.

It is to be understood that the specific embodiments and examples described above are by way of illustration, and not limitation. Various modifications may be made by one of ordinary skill, and the scope of the invention is as defined in the appended claims.

What is claimed is:

1. A method of using a baseball or softball fielding device for training a baseball fielder, comprising the steps of:

providing a baseball fielding training device comprising a:

a support surface, and a plurality of spaced apart bump elements positioned on the support surface;

the support surface comprising an arced front edge, and a rear edge, the plurality of spaced apart bump elements comprising:

a first plurality of spaced apart first row bump elements configured to deflect the trajectory of a ball impacting one of the plurality of bump elements, the plurality of bump elements aligned along a first arc concentric with the arced front edge, the first plurality of spaced apart first row bump elements configured to form a gap between adjacent first row bump elements, and a second plurality of spaced apart second row bump elements configured to deflect the trajectory of a ball impacting the one of the plurality of bump elements aligned along a second arc concentric to, and to the rear of the first arc, such that each one of the plurality of second row bump elements is positioned to the rear of the gap formed between adjacent first row bump elements;

placing the baseball fielding training device on a practice field or a floor;

positioning a player behind the training device;

rolling a baseball toward the training device, such that contact with at least one of the plurality of bump elements on the support surface causes the baseball to create an unpredictable hop or bounce upon contact with the at least one of the plurality of bump elements; and instructing the player to field the baseballs on the hop or bounce.

2. The method of using a baseball or softball fielding device of claim 1, further comprising making a plurality of baseball rolls at the baseball fielding training device, and instructing the player to field the plurality of baseball rolls on each hop or bounce.

3. The method of using a baseball or softball fielding device of claim 1, wherein the support surface is planar.

4. The method of using a baseball or softball fielding device of claim 1, wherein the support surface is a solid polymer sheet.

5. The method of using a baseball or softball fielding device of claim 1, wherein the support surface is a mesh.

6. The method of using a baseball or softball fielding device of claim 1, wherein the support surface is a flexible mat and are easily rolled.

7. The method of using a baseball or softball fielding device of claim 1, wherein the plurality of spaced apart bump elements are hemispherical in shape and comprise a circular base.

8. The method of using a baseball or softball fielding device of claim 1, wherein the plurality of spaced apart bump elements are hemispherical in shape and comprise an elliptical base.

9. The method of using a baseball or softball fielding device of claim 1, wherein the plurality of spaced apart bump elements are irregular in shape.

10. The method of using a baseball or softball fielding device of claim 1, wherein the plurality of spaced apart bump elements are irregularly spaced.

11. The method of using a baseball or softball fielding device of claim 1, further comprising a carry strap or sling.

12. The method of using a baseball or softball fielding device of claim 1, wherein the plurality of bump elements are integral to the support surface.

13. The method of using a baseball or softball fielding device of claim 1, wherein the plurality of bump elements are embedded in or attached to the support surface.

14. The method of using a baseball or softball field device of claim 1, wherein the support surface is formed of two or more sections and the plurality of bumps are hollow;

wherein the two or more sections are stackable and the plurality of bumps from one section are partially nested within the hollow pumps of the other of the two or more sections.

* * * * *